United States Patent [19]

Voorhes

[11] 4,041,595

[45] Aug. 16, 1977

[54] EXTRUSION PROCESS

[75] Inventor: William G. Voorhes, East Greenwich, R.I.

[73] Assignee: Wanskuck Company, Providence, R.I.

[21] Appl. No.: 691,353

[22] Filed: June 1, 1976

[51] Int. Cl.[2] ..... B21C 27/00; B21C 33/00

[52] U.S. Cl. ..... 29/420; 72/262; 72/272

[58] Field of Search ..... 72/270, 271, 272, 262; 29/420

[56] References Cited

U.S. PATENT DOCUMENTS

| | | | |
|---|---|---|---|
| 3,674,390 | 7/1972 | Sturgeon et al. | 29/420 |
| 3,922,898 | 12/1975 | Voorhes | 72/270 |

*Primary Examiner*—Lowell A. Larson
*Attorney, Agent, or Firm*—Barlow & Barlow

[57] ABSTRACT

An improved extrusion process and apparatus for extruding feedstock is disclosed in which the gripping force for the extrusion is derived by forcing the feedstock into a passageway to develop in the feedstock on two opposing surfaces a pressure of at least the yield strength of the feedstock and moving the feedstock toward a stop and die means located at the end of a passageway and particularly that improvement consisting of providing a fork-shaped element that forms the passageway with a distance between the constraining walls sufficiently greater than the height of the wall surfaces so that no lubrication of the ungripped surfaces of the feedstock is required.

6 Claims, 6 Drawing Figures

EXTRUSION PROCESS

BACKGROUND OF THE INVENTION

In U.S. Pat. No. 3,765,216 a basic form of extruding feedstock through a die was disclosed. In U.S. Pat. No. 3,922,898 dated Dec. 2, 1975, there is disclosed a different form of apparatus where, by applying a gripping pressure greater than the yield strength of the feedstock material throughout the length of the passageway, two-sided gripping could be utilized to extrude feedstock. In this patent it was also stated that in order for the extrusion to take place, it was necessary to lubricate the two ungripped sides of the feedstock.

SUMMARY OF THE INVENTION

There are occasions when it is desirable to operate without lubrication. The main object of this invention is to provide an improved apparatus and particularly a method for not only extruding feedstock as generally disclosed in U.S. Pat. No. 3,922,898 but extruding this feedstock without the necessity of lubricating the ungripped sides. In the prior patent the aspect ratio, that is the width to height ratio within the extrusion passageway, is substantially unity in its preferred form. The present invention discloses that it is possible to operate without lubrication by designing the extrusion passageway to have an aspect ratio significantly greater than unity, and to utilize, for example, an aspect ratio of approximately three.

Briefly, therefore, the present invention consists in the discovery that the steps of forcing feedstock into a groove or passageway to plastically deform the same may be performed by first gripping the feedstock with a pressure of at least the yield strength of the feedstock and moving the feedstock toward a stop and die means at the end of a passageway which has a width as related to the height between the gripped surfaces that is significantly greater than unity and preferably on the order of a factor of two or more.

DESCRIPTION OF THE PREFERRED EMBODIMENT

Figure 2:
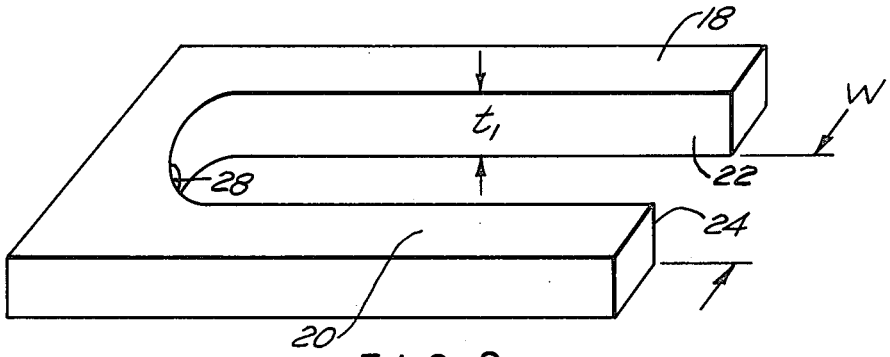
FIG. 2 is a perspective view of the fork that forms the passageway for the extrusion of the material.
Figure 3:
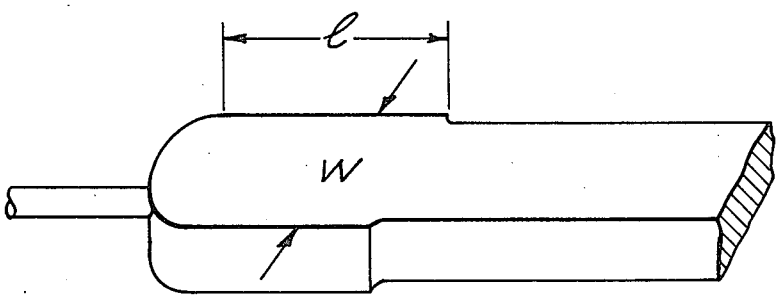
FIG. 3 is a diagrammatic view of material which would lie within the passageway formed by the fork of FIG. 2 and illustrating its normal configuration during extrusion.

In its most elemental form the present invention consists of a pair of plates 10 and 11 which provide opposing surfaces 12 and 14 that are adapted to grip the feedstock F. An extrusion fork generally designated 16 is provided with a pair of legs 18, 20 which respectively have inner walls 22, 24. The legs 18 and 20 are joined by a base portion 26 and in the base portion is located an orifice 28 which is of a shape of the product to be extruded and which effectively forms a die. The legs 18, 20 and the plates 10, 11 form a passageway and the base 26 forms a stop. The fork 16 has a thickness $t_1$ (see FIG. 2) and a width between the walls 22, 24 indicated by the letter W. $W = N t_1$, where $N$ is the aspect ratio, and where $N \geqq 1$. As in U.S. Pat. No. 3,922,898, feedstock F is clamped on two opposed surfaces A and B thereof by the blocks 10 and 11 which exert pressures $P_1$ as shown by the arrows, which pressures $P_1$ are at least the yield strength of the material of the feedstock F, it being understood that the initial thickness $t_2$ of the feedstock before clamping exceeds its thickness $t_1$ after clamping. Relative motion is now achieved between the fork 16 and the blocks 10 and 11 which are clamping the feedstock F. As the blocks move the feedstock into the fork and the feedstock strikes the base portion 26 of the fork, axial compressive stress is set up in the feedstock and this stress increases until it exceeds the yield strength of the feedstock causing the feedstock to upset and fill the fork widthwise for a length $l$ which is known as the upset length.

As explained by Green in his U.S. Pat. No. 3,765,216 and the article in Journal of the Institute of Metals, 1972, Vol. 100, p. 295, the relationship between this upset length $l$, the die thickness $t_1$, the pressure $P$ at the die face during extrusion and the yield strength Y can be expressed $$l/t_1 = P/Y \tag{1}$$

From Rathke, ASME paper 73 -WA/PT-4, 1973, we learn that the pressure profile decreases exponentially along the feedstock in proximity to the die. Accordingly, the average pressure along length $l$ may be approximated $$P_{AVG} = (P + 2Y)/3 \tag{2}$$

Figure 1:
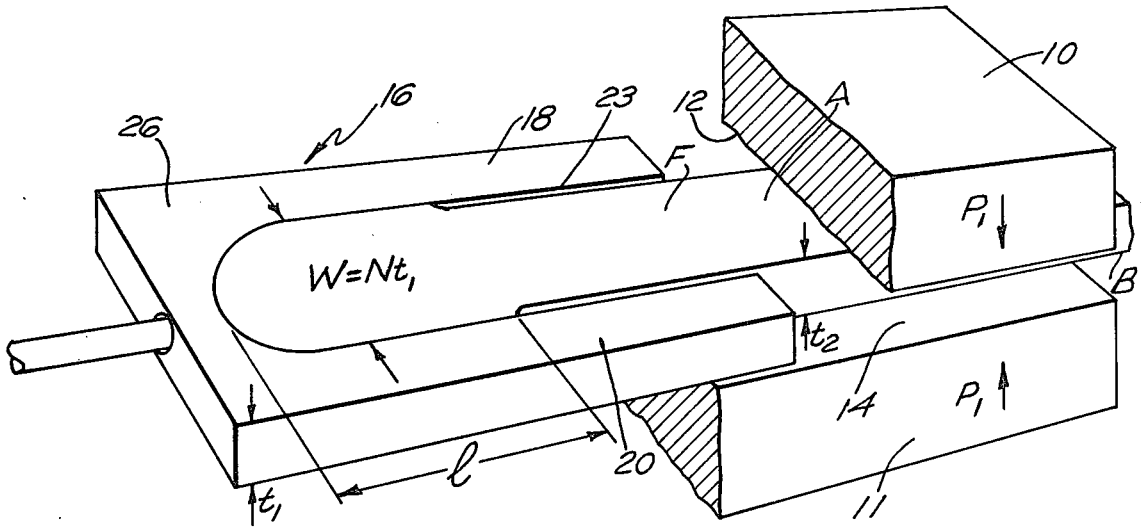
FIG. 1 represents a detached perspective view of a basic form of apparatus for practicing the present invention.

Now determine the pressure required at the die face for extrusion in a system where two sides of the feedstock are gripped and the ungripped surfaces are free to upset against the legs of a fork. First assume that the thickness of feedstock is $t_1$ after the two sides are gripped (see FIG. 1) and that the spacing between the legs of the fork is W, where $W = Nt_1$ and where $N \geqq 1$. The force exerted aginst the fork can be expressed:

$$\text{FORCE}_{FORK} = P_0 N t_1^2 + \text{FORCE}_{FRICTION} \tag{3}$$

where $P_0$ is the pressure which would be required for extrusion if there were no friction between the upset feedstock and the legs of the fork, where $Nt_1^2$ is the cross sectional area of the die face and where $$\text{FORCE}_{FRICTION}$$

is the force required to overcome friction between the upset feedstock and the legs of the fork. But $$\text{FORCE}_{FRICTION} = P_{AVG} \cdot \mu \cdot 2 \cdot l \cdot t_1 \tag{4}$$

where $\mu$ is the coefficient of friction between the feedstock and the two legs. Therefore, $$\text{FORCE}_{FORK} = P_0 N t_1^2 + P_{AVG} \cdot \mu \cdot 2 \cdot l \cdot t_1 \tag{5}$$

The pressure at the die face can be expressed $$P = \frac{\text{FORCE}_{FORK}}{N t_1^2} \tag{6}$$

so that $$P=P_0+P_{AVG}\mu\cdot 2l/Nt_1 \quad (7)$$

and therefore $$P=P_o+[(P+2y)/3](\mu\cdot 2l/Nt_1) \quad (8)$$

But, from equation (1), $P=lY/t_1$; upon substituting for $P$ in equation (8), it can be shown that $$(2\mu Y/t_1)l^2+(4\mu-3N)\ Yl+3Nt_1P_o=0$$

for which the reasonable solution is $$l=(t_1/4\mu)[(3N-4\mu)-\sqrt{(3N-4\mu)^2-24\mu NP_o/Y}] \quad (9)$$

This equation (9) covers the general case for $N\geqq 1$, and is to be compared with a similar equation (8) of my prior U.S. Pat. No. 3,922,898 which covers on the case where $N=1$.

Since, from equation (1), $l=Pt_1/Y$ $$P=(Y/4\mu)[(3N31\ 4\mu)-\sqrt{(3N-4\mu)^2-24\mu NP_o/Y}] \quad (10)$$

where $N\geqq 1$ and where there is lubrication.

Referring again to equation (7), if there is no lubrication between the upset feedstock and the die legs, the feedstock will shear at the feedstock-die leg interfaces, so that the $P_{AVG}\mu$ term can be set equal to $K$, where $K$ is the shear strength of the feedstock. As explained by Green in his U.S. Pat. No. 3,765,216, $K=Y/2$ and therefore $$P_{AVG}\cdot\mu=(Y/2)$$

Upon substituting for $P_{AVG}\mu$ in equation (7), we obtain $$P=P_o+(Yl/Nt_1)$$

But, from equation (1), $(Yl/t_1)=P$ so it can be shown that $$P=\frac{P_0}{(1-\frac{1}{N})} \quad \text{(ii)}$$

where $N\geqq 1$ and where there is no lubrication.

To evaluate the instant system as against the system set forth in U.S. Pat. No. 3,922,898, let us assume that $P_0=3Y$, that $\mu=0.05$ for the lubricated extruder and that N has a value of 1, 2 or 3. Solving for $P$ in equations (10) and (11) we have obtained the following:

| | N = 1 | N = 2 | N = 3 |
|---|---|---|---|
| $P_{NON\text{-}LUBRICATION}$ | ∞ | 6.0Y | 4.5Y |
| $P_{LUBRICATION}$ | 3.7Y | 3.3Y | 3.2Y |

From the above, it is reasonable to conclude that the system can operate without feedstock lubrication as long as the aspect ratio is greater than 2, it being noted that if $N=2.5$, $P=5.0Y$. It is, of course, recognized that as the aspect ratio increases, the extrusion pressure decreases, i.e., if $N=4$, $P=4.0Y$. Experiments illustrate that flashing, that is, the tendency of the material being extruded to pass over the face of the base 26, increases as the aspect ratio is increased. In practice, the value of $N$ must be high enough to keep the extrusion force reasonably low but not so high as to permit excessive flashing. Practical results have been obtained where $N=3$.

It should be understood that the apparatus for performing the process will be of the same configuration as previously disclosed in U.S. Pat. No. 3,922,898 and that FIGS. 3 through 11 and the description thereof are hereby incorporated by reference.

DESCRIPTION OF ALTERNATE EMBODIMENT

The extrusion apparatus disclosed in U.S. Pat. No. 3,922,898 can be used to extrude certain metal powders. For example, if aluminum powders are packed into an aluminum tube and the tube is then pulled through a Turks Head to obtain a rectangular cross section, the composite can be used as the feedstock for the extrusion apparatus shown in said patent if the resulting composite is lubricated on the two ungripped surfaces. The heat and pressure developed during the extrusion will be sufficient to achieve complete bonding within the extruded product, not only between the powder particles themselves but also between the particles and the tube. The resulting extruded product will possess a tensile strength approaching that of a product extruded from an equivalent solid feedstock.

In the process just described, the metal powder is packed into a tube so that lubrication can be applied to the ungripped surfaces. It would be desirable to eliminate the need for lubrication so that the powder feedstock could be fed into the extrusion apparatus directly. This can be accomplished by utilizing an extrusion passageway having an aspect ratio of approximately three.

Having the capability of using powders as feedstocks permits the production of certain mechanical alloys which are difficult or impossible to produce by other metallurgical techniques. An example would be an alloy composed of a metal matrix and a metal oxide dispersion. Several other examples are given by J. S. Benjamin in his article "Mechanical Alloying," *SCIENTIFIC AMERICAN*, May 1976, Volume 234, Number 5, Page 40.

Figure 4:
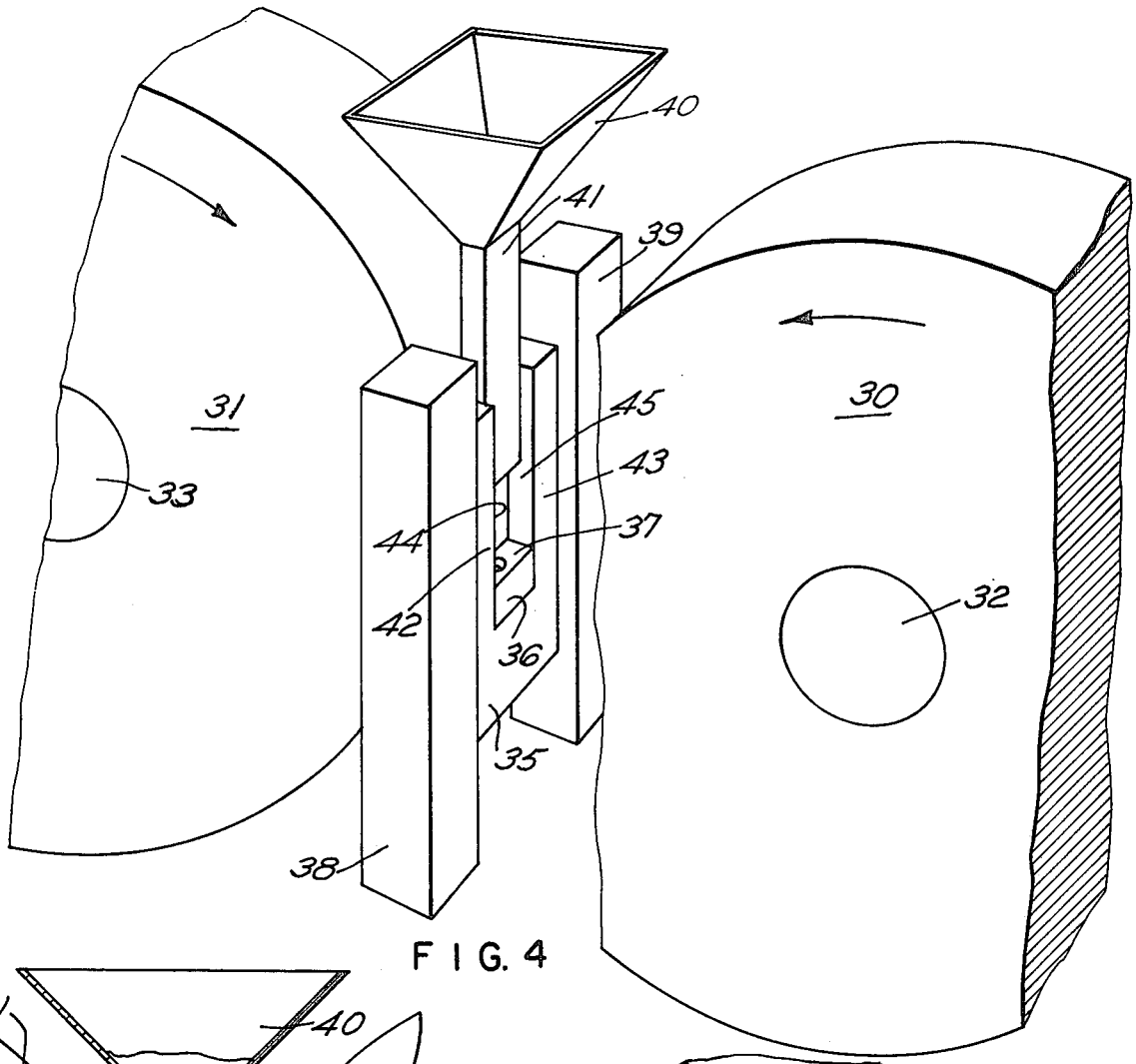
FIG. 4 is a perspective view with parts broken away showing another form of apparatus for particulate material.
Figure 6:
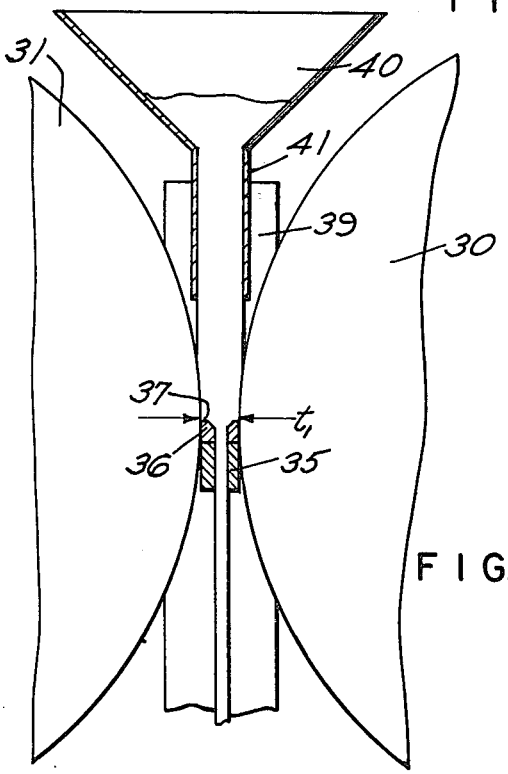
FIGS. 5 and 6 are central transverse sectional views of FIG. 4.
Figure 5:
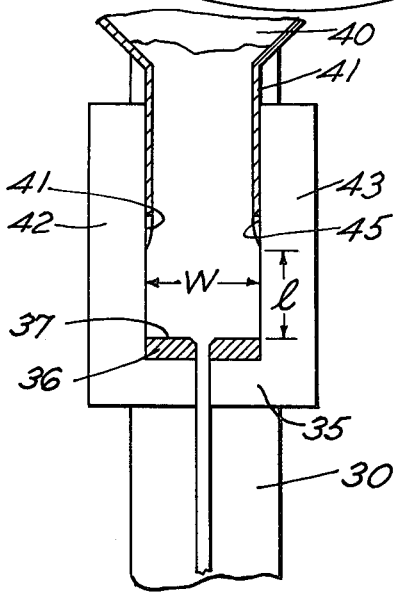

Referring now to FIGS. 4, 5 and 6 of the drawings, there is shown a form of the device of the invention which can be utilized to extrude continuously a metal powder feedstock into a solid product. To this end, a pair of circular blocks 30 and 31 rotate respectively about shafts 32 and 33 in the direction of the arrows. A fork 35 having a thickness $t_1$ and containing a die insert 36 is positioned between the two rotating blocks and held in position by retaining members 38 and 39 that embrace the fork. As seen in FIG. 4, a feed hopper 40 is provided with an elongated exit conduit 41 that leads between the two legs of the fork 35, which legs are designated 42 and 43. The inner facing walls of these forked legs designated respectively 44 and 45 are spaced apart a distance W as disclosed above and preferably in the order where the distance W will be approximately on the order of $3t_1$. It will be apparent reviewing the drawing that as the powdered metallic material comes down on the hopper 40 and is conducted through the conductor 41 between the legs 42 and 43 that it will fall into the area between the outer circumferential faces of the rotating blocks 30 and 31 (see FIG. 6). Due to the physical arrangement of the thickness $t_1$ as related to the width W, the metallic material will be compressed, and as the blocks rotate, this compressed material is forced against the die 36 and more specifically the die face 37 thereof, the feedstock thereby upsetting over a length $l$ as disclosed previously and extruding through the orifice in the die insert 36.

I claim:

1. A process of continuously forming feedstock comprising the steps of providing a gripping means, gripping two opposed sides of feedstock material whereby the two opposing sides of the material are compressed to a pressure greater than the yield strength of the material, providing a fork-shaped element having opposed constraining walls, locating a die means in the vicinity of the base of the fork, moving the feedstock toward the die means by the gripping means, maintaining the gripping force greater than the yield strength of the material throughout the fork-shaped element, whereby as the feedstock is urged against the base of the fork, the feedstock upsets against the constraining wall surfaces and passes out through the die means, the gripping means advancing the feedstock into the fork, said gripping means and constraining wall surfaces of said fork forming a passageway, that improvement consisting of providing a fork-shaped element in which the distance between the constraining walls is not less than two times the height of said wall surfaces so that no lubrication of the ungripped surfaces of the feedstock is required.

2. Extrusion apparatus including first and second means forming a passageway, the first and second means being movable relative to each other in the direction of the length of the passageway, a stop blocking the passageway and an extrusion orifice near the stop, said first means applying a compressive force on the feedstock greater than the yield strength of the feedstock material and advancing the feedstock through the passageway between the opposed walls of the second means, said first means maintaining the compressive force greater than the yield strength throughout, the feedstock upsetting and passing out through the extrusion orifice, that improvement characterized by the distance between opposed walls of the second means being not less than two times the distance between the first means whereby lubrication may be omitted.

3. Extrusion apparatus comprising a first gripping means, and a second wall means comprising a fork-shaped member having two opposed walls and a base section, said gripping means and said second means being relatively movable, said gripping means operating on two opposed sides of feedstock material, said first and second means defining a passageway, a die means with an orifice positioned between said opposed walls in the vicinity of the base section, and means for moving one of said two means whereby feedstock material is moved toward said die, the distance between the opposed walls of the second means being at least two times the distance between the gripping means, said gripping means applying a compressive force to the feedstock greater than the yield strength of the feedstock, the gripping means advancing the feedstock through the die and maintaining the gripping force greater than the yield strength of the material throughout the fork-shaped member.

4. Extrusion apparatus as in claim 3 wherein the first means comprises a pair of circular wheels having outer circumferential surfaces facing each other and rotating on parallel axes.

5. Extrusion apparatus as in claim 3 wherein the second means comprises a fork-shaped element having two opposed walls and a base section.

6. Extrusion apparatus as in claim 3 wherein a hopper and a conduit leading therefrom is arranged so the conduit discharges particulate feedstock material in said passageway.

* * * * *